US006085685A

United States Patent [19]

Morishige

[11] Patent Number: 6,085,685

[45] Date of Patent: Jul. 11, 2000

[54] SPRAY DEFLECTOR FOR A PERSONAL WATERCRAFT, JET SKI OR BOAT

[76] Inventor: Tim Morishige, 5231 Loyola Ave., Westminster, Calif. 92683-2724

[21] Appl. No.: 09/122,365

[22] Filed: Jul. 27, 1998

[51] Int. Cl.[7] ..... B63B 8/00

[52] U.S. Cl. ..... 114/343; 114/271

[58] Field of Search ..... 114/271, 288–291, 114/343; D12/300, 309, 310, 311, 313, 317

[56] References Cited

U.S. PATENT DOCUMENTS 5,237,953 8/1993 Mannerfelt ..... 114/288
5,425,325 6/1995 Washio ..... 114/290
5,588,388 12/1996 Maruyama et al. ..... 114/288
5,706,751 1/1998 Hodges ..... 114/343

*Primary Examiner*—Ed Swinehart

[57] ABSTRACT

A spray deflector for a personal watercraft, jet ski or boat including at least one pair of guards adapted for securement to opposing sides of a bow of a boat. Each of the guards have a pair of countersunk holes extending therethrough. An interior surface of each of the guards is positioned against a surface of the bow of the boat with a pair of screws extending through the countersunk holes for securement of the guards to the bow of the boat.

7 Claims, 4 Drawing Sheets

SPRAY DEFLECTOR FOR A PERSONAL WATERCRAFT, JET SKI OR BOAT

BACKGROUND OF THE INVENTION

1. Field of the Invention

The present invention relates to a spray deflector for a personal watercraft, jet ski or boat and more particularly pertains to eliminating the spray of water into a boat riders face with a spray deflector for a personal watercraft, jet ski or boat.

2. Description of the Prior Art

The use of splash guards is known in the prior art. More specifically, splash guards heretofore devised and utilized for the purpose of guarding against splashed water are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,313,907 to Hodges; U.S. Pat. No. 5,425,325 to Washio; U.S. Pat. No. Des. 357,892 to Rolland et al.; U.S. Pat. No. 5,205,235 to Hodges; U.S. Pat. No. 4,927,177 to Price; and U.S. Pat. No. 4,323,355 to Kondo.

While these devices fulfill their respective, particular objective and requirements, the aforementioned patents do not describe a spray deflector for a personal watercraft, jet ski or boat for eliminating the spray of water into a boat riders face.

In this respect, the spray deflector for a personal watercraft, jet ski or boat according to the present invention substantially departs from the conventional concepts and designs of the prior art, and in doing so provides an apparatus primarily developed for the purpose of eliminating the spray of water into a boat riders face.

Therefore, it can be appreciated that there exists a continuing need for new and improved spray deflector for a personal watercraft, jet ski or boat which can be used for eliminating the spray of water into a boat riders face. In this regard, the present invention substantially fulfills this need.

SUMMARY OF THE INVENTION

In the view of the foregoing disadvantages inherent in the known types of splash guards now present in the prior art, the present invention provides an improved spray deflector for a personal watercraft, jet ski or boat. As such, the general purpose of the present invention, which will be described subsequently in greater detail, is to provide a new and improved spray deflector for a personal watercraft, jet ski or boat and method which has all the advantages of the prior art and none of the disadvantages.

To attain this, the present invention essentially comprises a pair of guards adapted for securement to opposing sides of a bow of a personal watercraft, jet ski or boat. Each of the guards have a generally triangular configuration. Each of the guards have a forward end and a rearward end. The forward end has a width greater than a width of the rearward end. Each of the guards have a planar interior surface, a planar outer surface and an arcuate lower surface. Each of the guards have a pair of countersunk holes extending through the planar interior surface and the planar outer surface. The planar interior surface of each of the guards are positioned against a surface of the bow of the personal watercraft, jet ski or boat with a pair of screws extending through the countersunk holes for securement of the guards to the bow of the personal watercraft, jet ski or boat.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved spray deflector for a personal watercraft, jet ski or boat which has all the advantages of the prior art splash guards and none of the disadvantages.

It is another object of the present invention to provide a new and improved spray deflector for a personal watercraft, jet ski or boat which may be easily and efficiently manufactured and marketed.

It is a further object of the present invention to provide a new and improved spray deflector for a personal watercraft, jet ski or boat which is of durable and reliable construction.

An even further object of the present invention is to provide a new and improved spray deflector for a personal watercraft, jet ski or boat which is susceptible of a low cost of manufacture with regard to both materials and labor, and which accordingly is then susceptible of low prices of sale to the consuming public, thereby making such a spray deflector for a personal watercraft, jet ski or boat economically available to the buying public.

Even still another object of the present invention is to provide a new and improved spray deflector for a personal watercraft, jet ski or boat for eliminating the spray of water into a boat riders face.

Lastly, it is an object of the present invention to provide a new and improved spray deflector for a personal watercraft, jet ski or boat including at least one pair of guards adapted for securement to opposing sides of a bow of a personal watercraft, jet ski or boat. Each of the guards have a pair of countersunk holes extending therethrough. An interior surface of each of the guards is positioned against a surface of the bow of the personal watercraft, jet ski or boat with a pair of screws extending through the countersunk holes for securement of the guards to the bow of the personal watercraft, jet ski or boat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
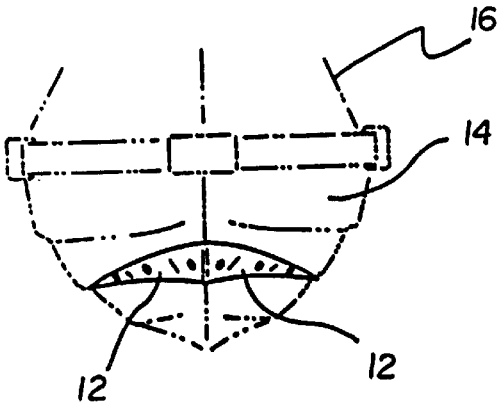
FIG. 1 is a front view of the preferred embodiment of the spray deflector for a personal watercraft, jet ski or boat constructed in accordance with the principles of the present invention.
Figure 2:
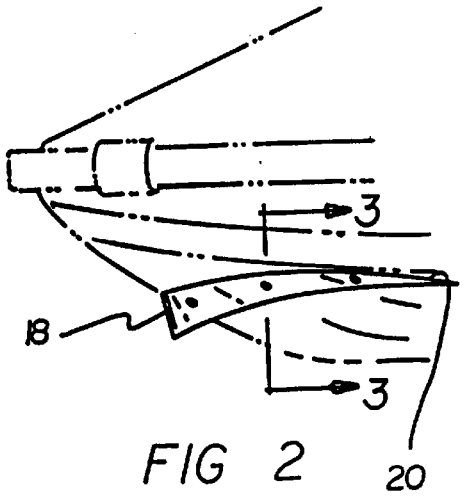
FIG. 2 is a side view of the present invention shown secured to a bow of a boat.
Figure 3:
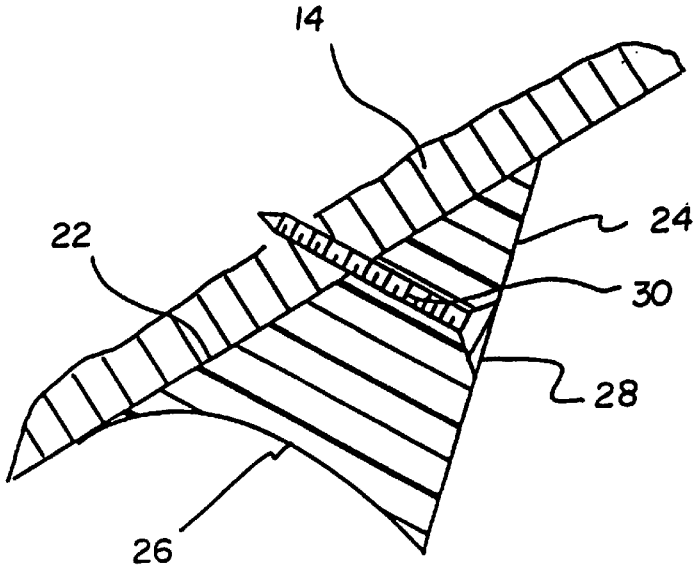
FIG. 3 is cross-sectional view as taken along line 3—3 of FIG. 2.

With reference now to the drawings, and in particular, to FIGS. 1 through 10 thereof, the preferred embodiment of the new and improved spray deflector for a personal watercraft, jet ski or boat embodying the principles and concepts of the present invention and generally designated by the reference number 10 will be described.

Specifically, it will be noted in the various Figures that the device relates to a spray deflector for a personal watercraft, jet ski or boat for eliminating the spray of water into a boat riders face. In its broadest context, the device consists of a pair of guards. Such components are individually configured and correlated with respect to each other so as to attain the desired objective.

The pair of guards 12 are adapted for securement to opposing sides of a bow 14 of a boat 16. Each of the guards 12 have a generally triangular configuration. Each of the guards 12 have a forward end 18 and a rearward end 20. The forward end 18 has a width greater than a width of the rearward end 20. Each of the guards 12 have a planar interior surface 22, a planar outer surface 24 and an arcuate lower surface 26. Each of the guards 12 have a pair of countersunk holes 28 extending through the planar interior surface 22 and the planar outer surface 24. The planar interior surface 22 of each of the guards 12 are positioned against a surface of the bow 14 of the boat 16 with a pair of screws 30 extending through the countersunk holes 28 for securement of the guards 12 to the bow 14 of the boat 16. The arcuate lower surface 26 serves to direct the water away from the boat 16 as the boat is directed through the water at high speeds thereby precluding the splashing of the water into the face of people on the boat 16.

Figure 4:
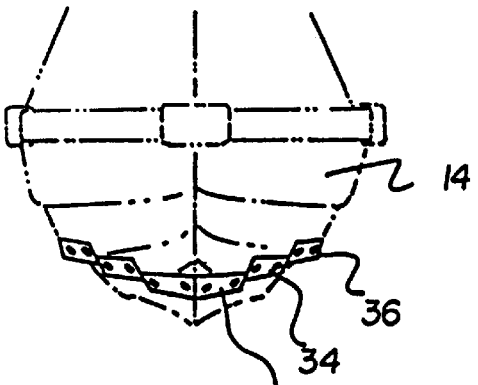
FIG. 4 is front view of an alternate embodiment of the present invention.
Figure 5:
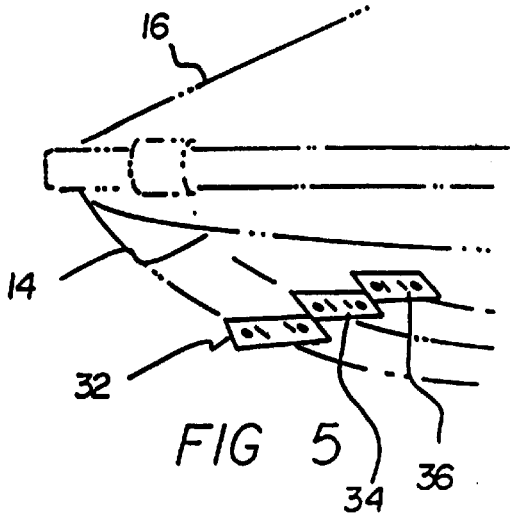
FIG. 5 is a side view of the alternate embodiment of the present invention.
Figure 6:
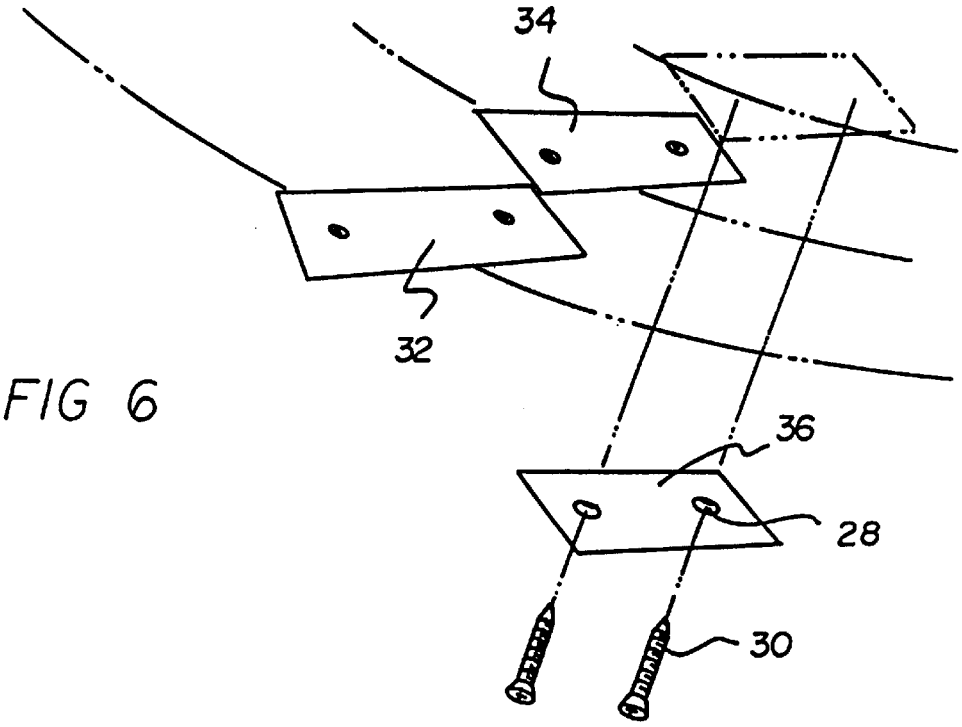
FIG. 6 is side view of the alternate embodiment shown separated from the bow of the boat.

A second embodiment of the present invention is shown in FIGS. 4–6 and includes substantially all of the components of the present invention wherein three pairs of guards 12 are positioned on opposing sides of the bow 14 of the boat 16. The three pair of guards include forward guards 32, intermediate guards 34 and rearward guards 36. The forward guards 32 are positioned below the intermediate guards 34 and the rearward guards 36 are positioned above the intermediate guards 34. This allows the guards 12 to extend further on the bow 14 of the boat 16 to further limit the amount of water splashing during movement of the boat 16.

Figure 7:
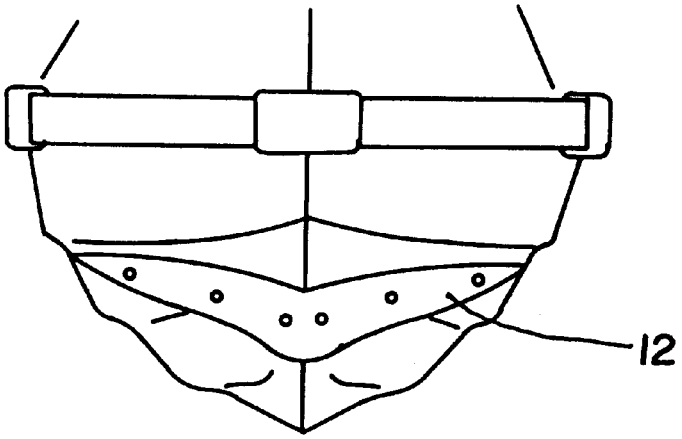
FIG. 7 is a front view of an alternate embodiment of the present invention.
Figure 8:
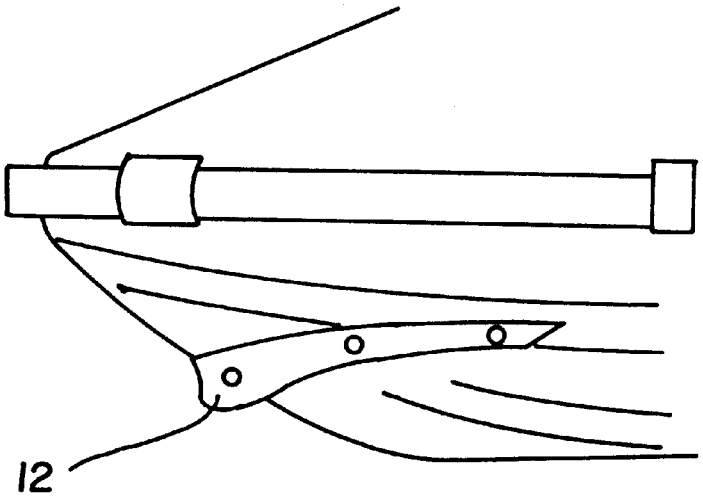
FIG. 8 is a side view of the alternate embodiment illustrated in FIG. 7.

A third embodiment of the present invention is shown in FIGS. 7 and 8 and includes substantially all of the components of the present invention wherein the pair of guards 12 are each provides with arcuate upper and lower edges.

Figure 9:
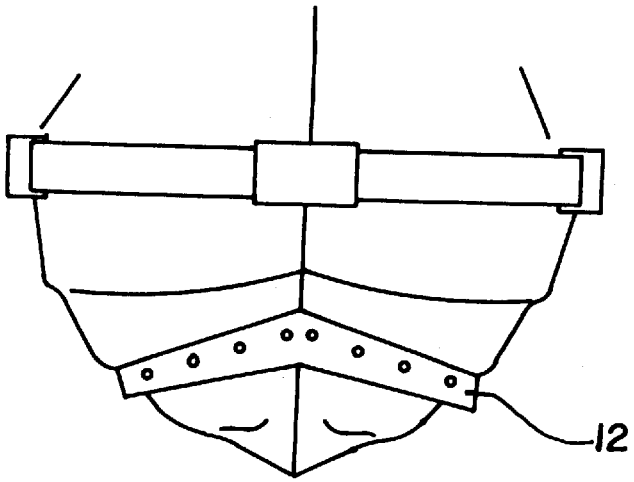
FIG. 9 is a is a front view of an alternate embodiment of the present invention.
Figure 10:
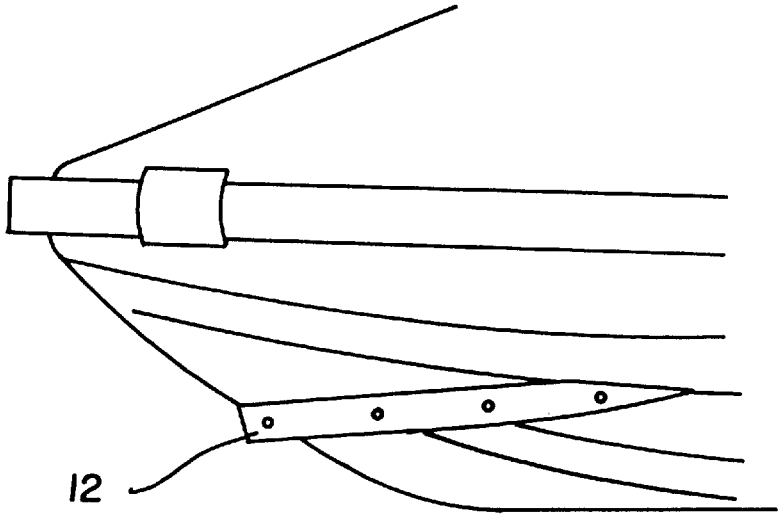
FIG. 10 is a side view of the alternate embodiment illustrated in FIG. 9.

A fourth embodiment of the present invention is shown in FIGS. 9 and 10 and includes substantially all of the components of the present invention wherein the pair of guards 12 are each provided with straight upper and lower edges.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A spray deflector for a personal watercraft, jet ski or boat for eliminating the spray of water into a boat riders face comprising, in combination:

a pair of guards adapted for securement to opposing sides of a bow of a boat, each of the guards having a generally triangular configuration, each of the guards having a forward end and a rearward end, the forward end having a width greater than a width of the rearward end, each of the guards having a planar interior surface, a planar outer surface and an arcuate lower surface, each of the guards having a pair of countersunk holes extending through the planar interior surface and the planar outer surface, the planar interior surface of each of the guards positioned against a surface of the bow of the boat with a pair of screws extending through the countersunk holes for securement of the guards to the bow of the boat.

2. A spray deflecting system for a personal watercraft, jet ski or boat comprising:

a plurality of pairs of guards adapted for securement to opposing sides of a bow of a personal watercraft, jet ski, or boat, each of the guards having a pair of countersunk holes extending therethrough, an interior surface of each of the guards positioned against a surface of the bow of the personal watercraft, jet ski, or boat, with a pair of screws extending through the countersunk holes for securement of the guards to the bow of the personal watercraft, jet ski or boat, each of the guards having a generally triangular configuration, and each of the guards further having a forward end and a rearward end, the forward end having a width greater than a width of the rearward end.

3. The spray deflector for a personal watercraft, jet ski, or boat as set forth in claim 2 wherein each of the guards have a planar interior surface, a planar outer surface and an arcuate lower surface.

4. The spray deflector for a personal watercraft, jet ski or boat as set forth in claim 2 wherein three pairs of guards are positioned on opposing sides of the bow of the boat.

5. The spray deflector for a personal watercraft, jet ski or boat as set forth in claim 4 wherein the three pair of guards include forward guards, intermediate guards and rearward guards, the forward guards positioned below the intermediate guards and the rearward guards positioned above the intermediate guards.

6. The spray deflector for a personal watercraft, jet ski or boat as set forth in claim 2 wherein the pair of guards are each provide with arcuate upper and lower edges.

7. The spray deflector for a personal watercraft, jet ski or boat as set forth in claim 2 wherein the pair of guards are each provided with straight upper and lower edges.

* * * * *